United States Patent [19]

Blair et al.

[11] Patent Number: 4,647,130

[45] Date of Patent: Mar. 3, 1987

[54] MOUNTING MEANS FOR HIGH DURABILITY DRAWER CONNECTOR

[75] Inventors: Bryce W. Blair, Hummelstown; Lawrence A. Hall, Harrisburg, both of Pa.

[73] Assignee: AMP Incorporated, Harrisburg, Pa.

[21] Appl. No.: 875,917

[22] Filed: Jun. 19, 1986

Related U.S. Application Data

[62] Division of Ser. No. 760,369, Jul. 30, 1985, abandoned.

[51] Int. Cl.[4] ..... H01R 13/631

[52] U.S. Cl. ..... 339/64 M; 339/75 M; 339/126 RS

[58] Field of Search ..... 339/14 P, 49 R, 49 B, 339/75 M, 64 R, 64 M, 126 R, 126 RS, 132 R, 132 B, 134

[56] References Cited

U.S. PATENT DOCUMENTS

| | | | |
|---|---|---|---|
| 3,089,925 | 5/1963 | Landstrom | 339/75 M |
| 3,091,748 | 5/1963 | Takes et al. | 339/64 R |
| 3,605,068 | 9/1971 | Rayburn | 339/49 R |
| 3,848,222 | 11/1974 | Lightner | 339/75 M |
| 4,008,939 | 2/1977 | Kinkaid et al. | 339/75 M |
| 4,483,575 | 11/1984 | Kruger et al. | 339/14 P |

OTHER PUBLICATIONS

*AMP Metrimate Pin and Socket Connectors*, Sep. 1983, AMP Incorporated, Harrisburg, PA, cover page, and pp 5–10, 34–37.

*Primary Examiner*—John McQuade
*Attorney, Agent, or Firm*—Anton P. Ness

[57] ABSTRACT

A high durability drawer connector is capable of blind mating and has a receptacle connector half having a plurality of spring arm contact terminals extending forwardly of a mating face, and a plug connector half having a like plurality of contact terminals having planar contact portions to engage the spring arm contacts upon mating. Guide pins forwardly of the plug housing enter alignment recesses of the receptacle housing and align the plug connector which is floatingly mounted to a drawer end panel. At a first unmated position the spring arms enter plug housing passageways and just engage the plug's contacts under low insertion force. A camming bearing surface on one of the plug's guide pins bears against a cooperating surface of the receptacle housing and cams the plug connector in a selected axially normal direction. The plug's contacts then firmly engage the spring arms from laterally thereof biasing them to achieve contact force, and the connectors are fully mated. An improved plug connector floating mounting means is also provided which centers the plug prior to mating, and can be used on standard drawer connectors requiring alignment.

4 Claims, 11 Drawing Figures

10
20
40
50
44
46
41
28
72A
72
D
54
β
60
56
26
30A
84A
30
84
58
98
86A
82
86
68
70A
80
30
66
78
62
64

α
86
84
82
80
78
76
74
72
70

MOUNTING MEANS FOR HIGH DURABILITY DRAWER CONNECTOR

This is a division of application Ser. No. 760,369 filed July 30, 1985, now abandoned.

FIELD OF THE INVENTION

This relates to the field of electrical connectors and more particularly to the field of rack and panel connectors.

BACKGROUND OF THE INVENTION

Connectors are known where one of a mating pair of multi-terminal electrical connectors is mounted on a rack panel, and the other of the mating pair is mounted on the end of a drawer. The connectors become mated when the drawer is inserted into the rack in a "blind" mating process. One such drawer connector is the METRIMATE Drawer Connector (trademark of AMP Incorporated, Harrisburg, Pa.). The plug connector half of the mating pair is mounted on the drawer by two shoulder screws providing a radial float mounting. Integrally molded guide pins on the mating end of the plug housing enter receiving recesses of the receptacle housing. Large tapered surfaces of the guide pins correct the alignment of the plug housing to the receptacle housing prior to mating of the plurality of male and female electrical terminals into electrical engagement with each other. Alignment by the guide pins is possible because of the radial float mounting of the plug permitting lateral movement along the drawer end panel. The two one-piece housings are polarized and are made of durable glass-filled thermoplastic material. The male and female contact terminals of the product are size 16 pin and socket types having an insertion force of approximately up to 2 lbs. per mated pair. For a connector having twenty-five circuits or pairs the total contact mating force due to resistance to insertion would be up to 50 lbs.

It would be desirable to provide a drawer connector having a substantially reduced contact insertion force.

It would also be desirable to provide a drawer connector having a high durability under repeated blind mating conditions.

It would be further desirable to provide a drawer connector having one-piece molded housings providing a built-in capability of increasing the contact force of terminal pairs after precise alignment and mechanical mating of the connector halves and respective contact pairs, which contact force provides electrical mating of the connector halves.

It would be even further desirable to provide an improved float mounting means for a drawer connector.

SUMMARY OF THE INVENTION

The connector of the present invention provides an integral one-piece molded plug housing and an integral one-piece molded receptacle housing polarized with respect to each other. Large integral guide pins extend forwardly from the mating face of the plug housing and have large half-conical bearing surfaces engageable with cooperating semicylindrical bearing surfaces about alignment recesses of the receptacle housing which receive the guide pins. A selected one of the guide pins has a camming surface along the inner axial surface of the guide pin engageable with a respective cooperating camming bearing surface of the receptacle to provide an axially normal force to preferably the plug housing, float mounted to the drawer end panel by a pair of shoulder screws.

The contacts of the present invention comprise cantilever beam contact arms in the receptacle connector matable with planar contact arms disposed in terminal-receiving passageways of the plug housing. The plug's contacts are secured against sidewalls of respective passageways opposed from the end of the plug connector having the camming surface. The receptacle's contacts are secured in terminal-receiving passageways against sidewalls of respective passageways opposed from the camming end of the receptacle connector, and have contact end portions extending forwardly from the passageways and forwardly of the mating face of the connector.

When the plug connector is brought into initial engagement with the receptacle connector, the guide pins enter the alignment recesses of the receptacle and the bearing surfaces thereof engage the cooperating bearing surfaces around the recesses to align the plug connector. The plug connector, moving axially forwardly in a now-aligned relationship, receives the contact end portions first of the one or several elongated receptacle ground contacts in electrical and mechanical engagement with a corresponding one or several ground contacts of the plug. The plug connector then receives signal and power ones of the receptacle contacts into passageways of respective signal and power contacts of the plug and just into engagement with contact portions of the signal and power contacts under low insertion force. Finally, the camming surface of the plug connector engages the cooperating camming surface of the receptacle, biasing the plug connector and its slightly engaged signal and power contacts firmly against the cantilever beam receptacle contacts whereupon full mating of all the contacts and the connectors has occurred. Such mating is accomplished at low insertion force due to initial engagement of the contacts, and durability of the connector is enhanced by reduced wear of the terminals while still providing necessary wiping action. A high durability connector for repeated mating cycles is provided by the one-piece integral molded connector housings which convert forward axial movement or momentum to cammed normal movement to generate contact force between the respective pairs of contacts.

In another aspect of the present invention, preferably the plug connector is mountable to the drawer end panel by two shoulder screws at opposite ends of the plug. The two large dimensioned oblong mounting holes through flanges of the plug connector may each have an elastomeric member elastically secured around opposing projections around the mounting hole and having an elongate shape with free sides elastically engaging a respective screw shank firmly on opposing sides thereof along the minor axis of the elongate elastomeric member. The two elongate elastomeric members preferably have their major axes at approximately opposing diagonals and symmetrically oriented with respect to the major axis of the plug connector and at a substantial angle therefrom; and with the two elongate shapes having their minor axes at relatively opposing diagonals to each other, they cause centering of the plug connector after mounting and prior to mating.

DETAILED DESCRIPTION OF THE PREFERRED EMBODIMENT

Figure 1:
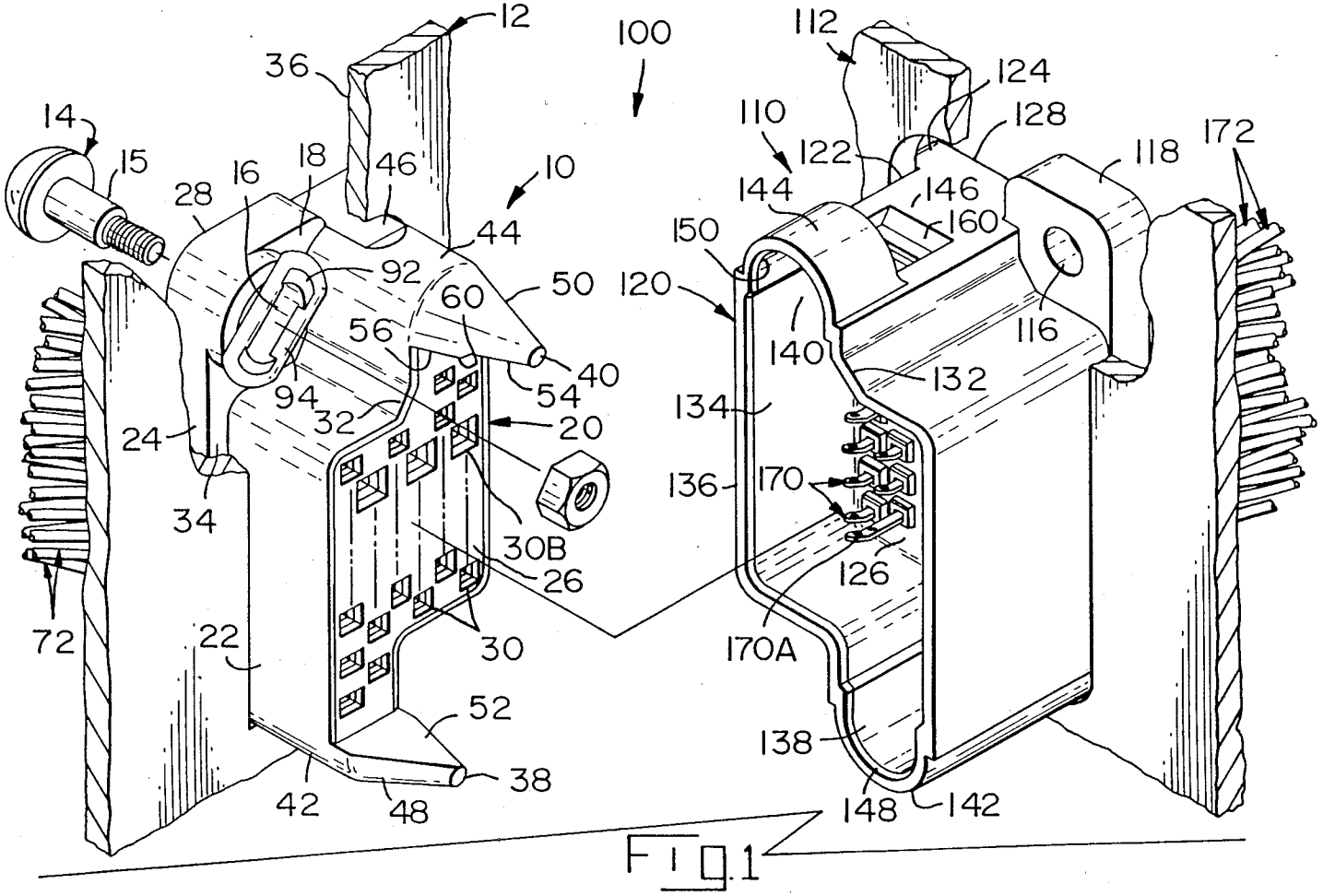
FIG. 1 is an assembly view of the plug connector and the mating receptacle connector of the present invention.
Figure 2:
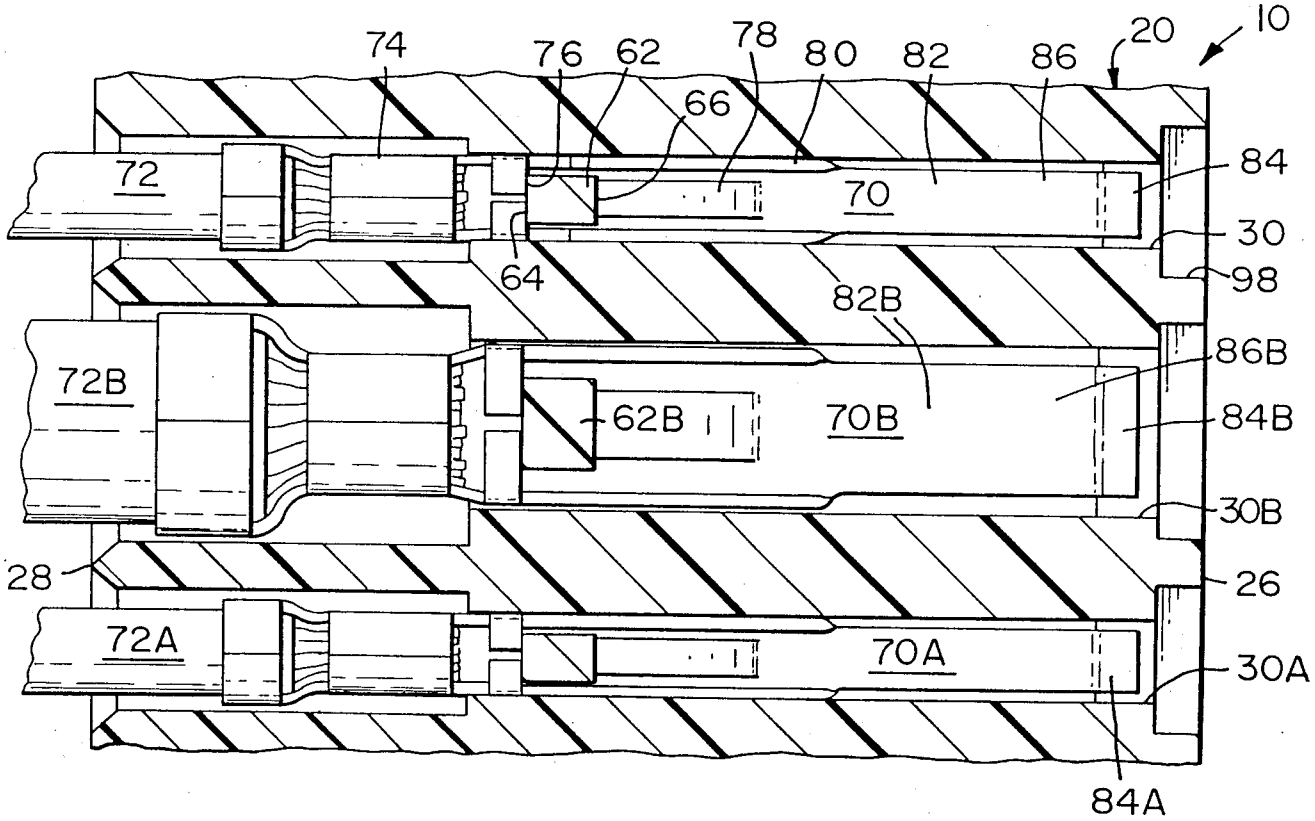
FIGS. 2 and 3 are top longitudinal section views of the plug connector and receptacle connector respectively, showing conductor-terminated signal, ground and power terminals in respective passageways.
Figures 3A, 4:
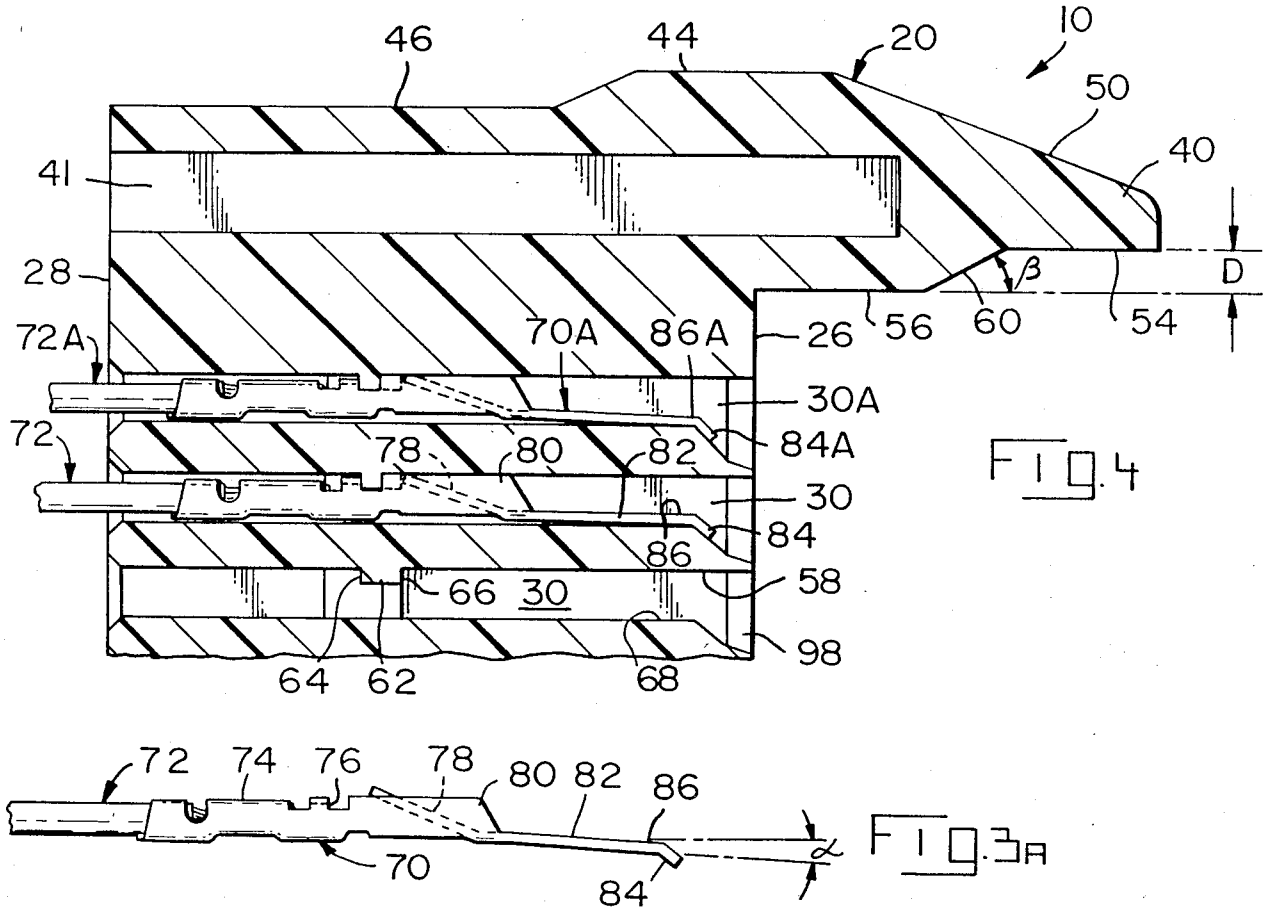
FIG. 3A is a side view of a respective terminal.
FIGS. 4 and 5 are part longitudinal section views of the plug and receptacle connectors prior to mating, showing a ground (upper) and signal (lower) terminal.

FIG. 1 shows a plug connector 10 mounted to an end panel 12 of a drawer by means of shoulder screws 14 extending through mounting holes 16 in flanges 18. Plug connector 10 comprises preferably a one-piece molded dielectric housing 20 of preferably a glass-filled polyester such as VALOX 420 SEO thermoplastic resin (trademark of General Electric Company.) Plug housing 20 has a body portion 22 extending axially forwardly from an integral base portion 24 to a mating face 26, and has a rear surface 28. Flanges 18 are parts of base portion 24 at opposing ends of the plug connector and diagonally disposed. Terminal-receiving passageways 30,30A,30B extend through plug housing 20 from mating face 26 to rear surface 28, within which are inserted and secured respective electrical plug contact terminals 70,70A,70B terminated to respective electrical conductors 72,72A,72B as seen in FIGS. 2 and 4.

Figure 3:
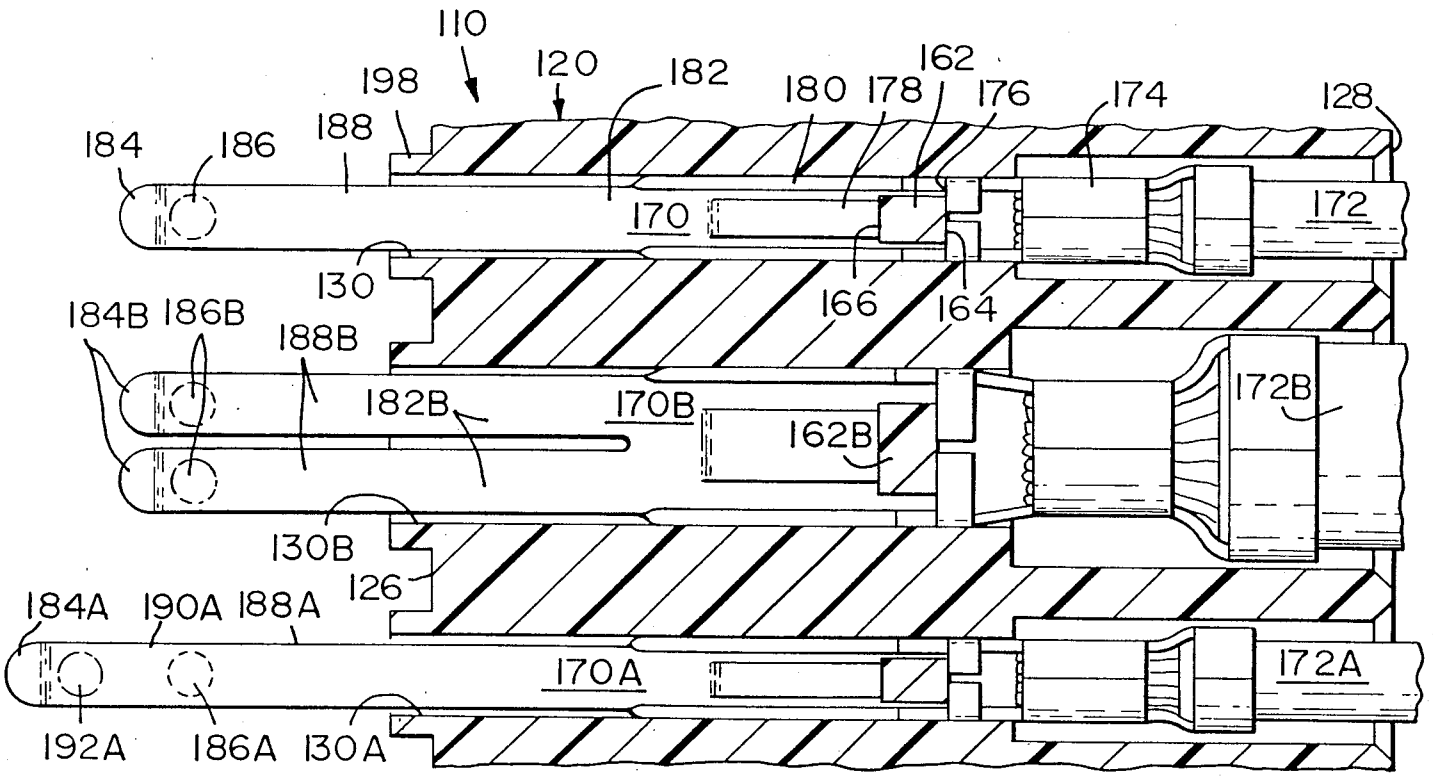
Figure 5:
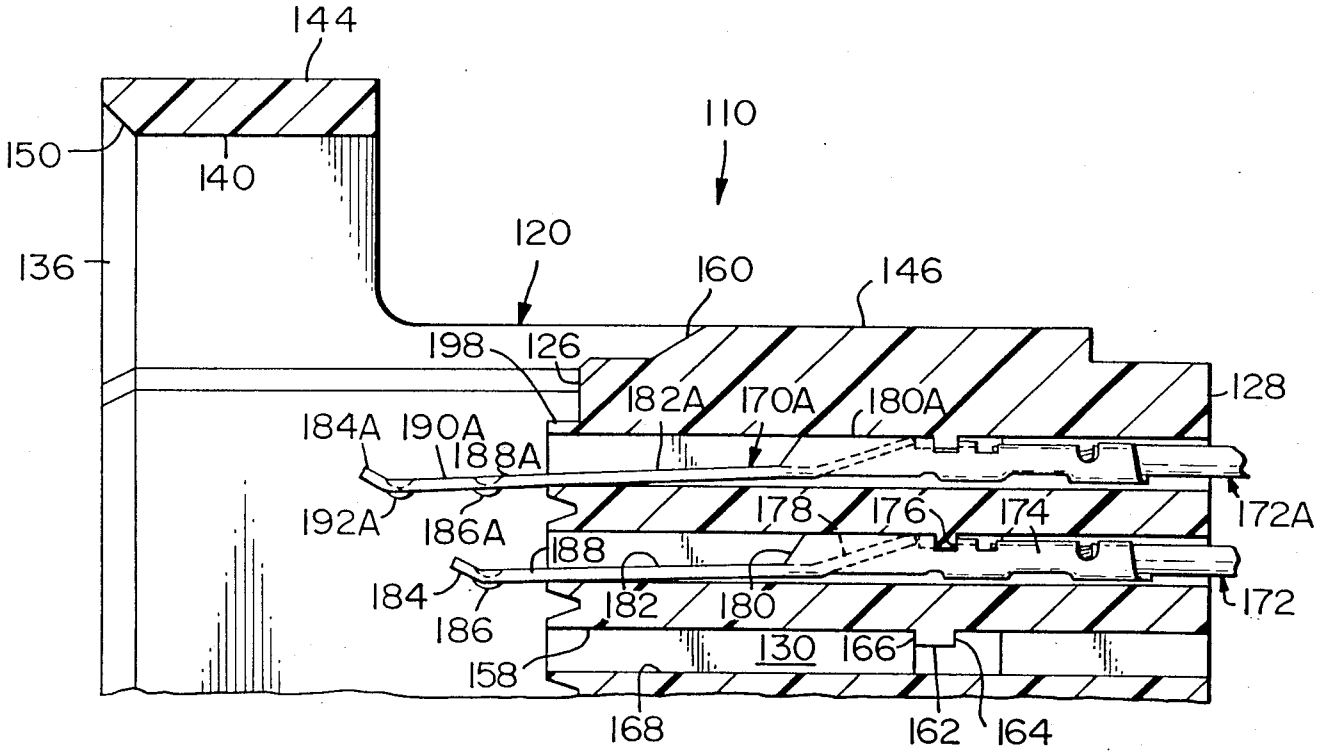
Figure 6:
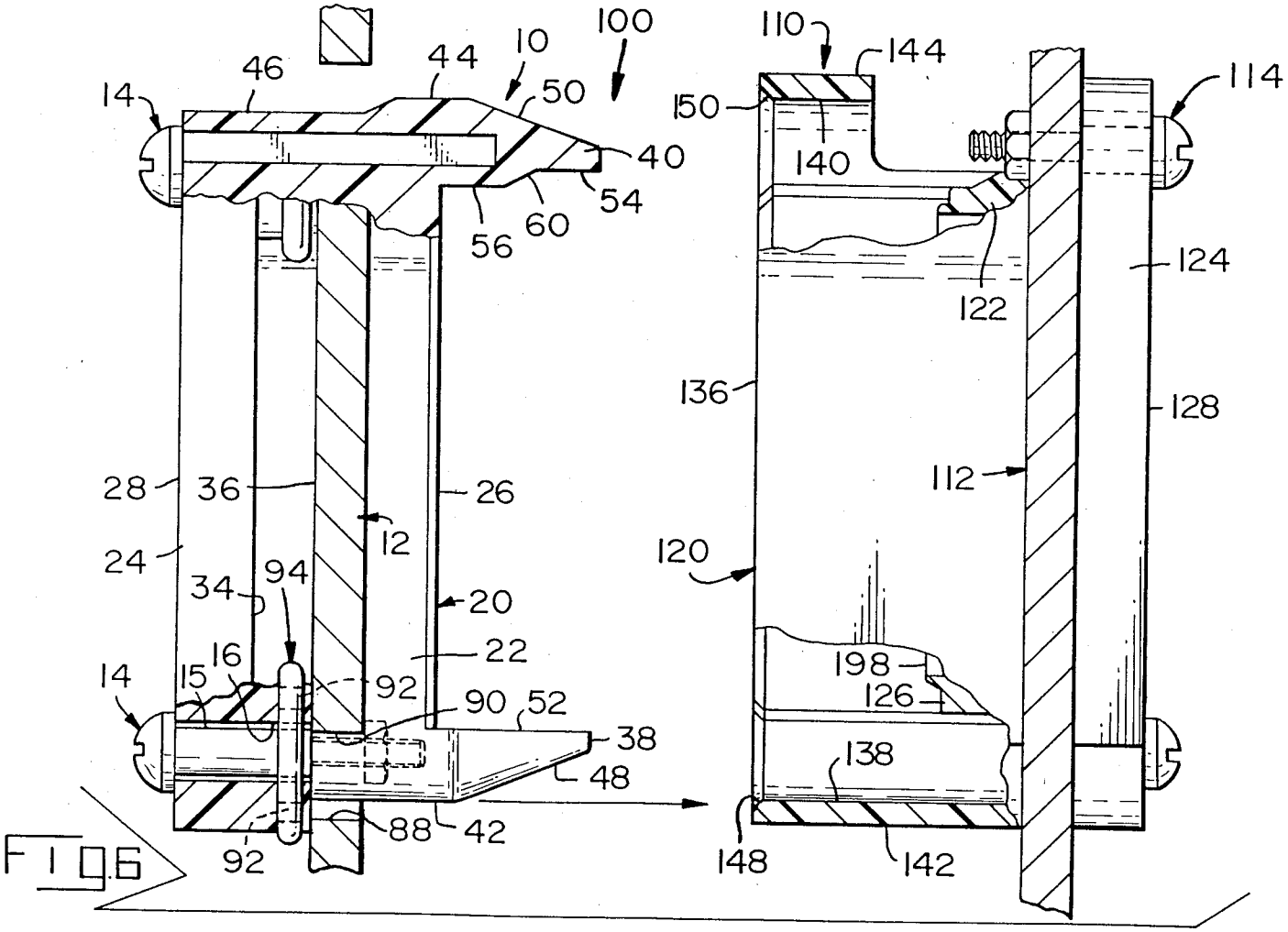
FIGS. 6 and 7 are side views of the plug and receptacle housings before and after mating, with end portions broken away.

In FIGS. 1 and 6, a receptacle connector 110 is mounted to panel 112 of a rack of a racking system by means of screws 114 extending through mounting holes 116 in flanges 118. Receptacle connector 110 also comprises preferably a one-piece molded dielectric housing 120 of preferably glass-filled polyester. Receptacle housing 120 has a body portion 122 extending axially forwardly from integral base portion 124 to a mating face 126, and has a rear surface 128. Terminal-receiving passageways 130,130A,130B extend through receptacle housing 120 from mating face 126 to rear surface 128, within which are inserted and secured respective electrical receptacle contact terminals 170,170A,170B terminated to respective electrical conductors 172,172A,172B as seen in FIGS. 3 and 5.

Plug connector 10 and receptacle connector 110 are matable to form a connector assembly 100, and are configured for polarized mating such as by means of angled inner corner 32 of body portion 22 of plug housing 20 and corresponding angled inner corner 132 of body portion 122 of receptacle housing 120. The mating of plug connector 10 and receptacle connector 110, which are mounted to panels 12,112 respectively is a blind mating requiring that they align themselves during mating and prior to plug body portion 22 entering large cavity 134 formed by receptacle hood 136 integral with and extending axially forwardly of the periphery of receptacle body portion 122.

Figure 7:
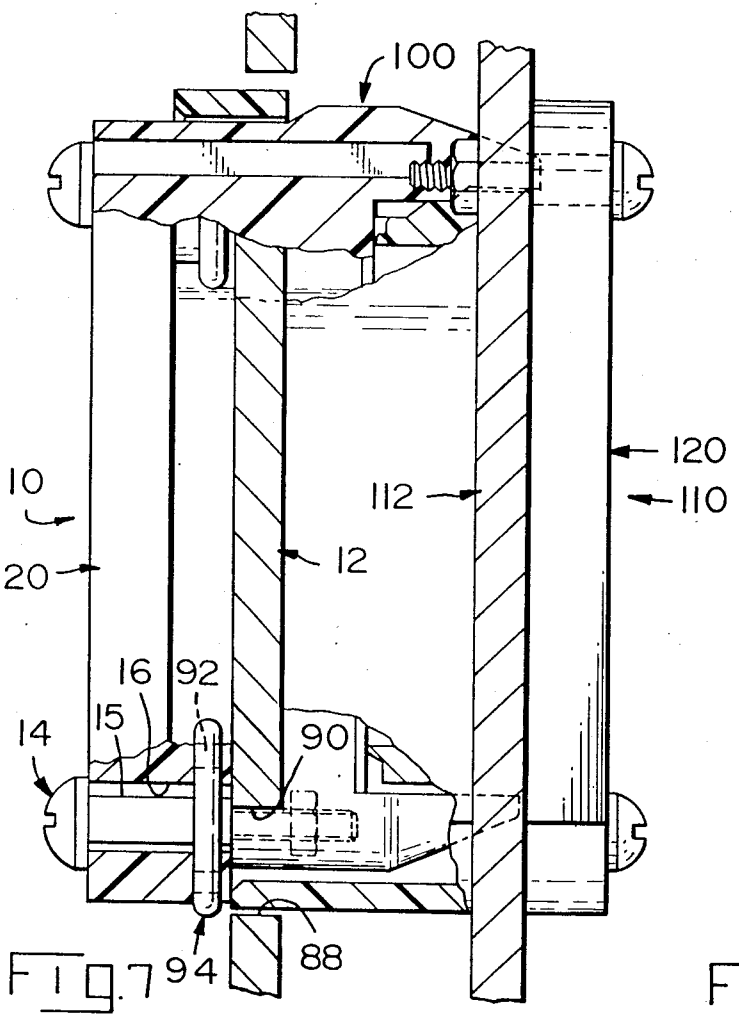

Referring to FIGS. 1, 6 and 7, guide pins 38,40 are disposed at opposite ends of plug housing 20 and preferably diagonally across from each other. Guide pins 38,40 preferably extend integrally forwardly from body portion 20 and forwardly of mating face 26. Guide pins 38,40 will be received in corresponding alignment recesses 138,140 respectively of receptacle hood 136, formed by hood sections 142,144.

Guide pins 38,40 preferably have alignment bearing surfaces 48,50 which comprise half-conical surfaces on outer sides of their forward ends. Alignment bearing surfaces 48,50 preferably extend continuously forwardly from semi-cylindrical axial side surfaces 42,44 of plug body portion 22 and smoothly tapered to an angle preferably of about 30°. Guide pin 38 preferably has a planar axial inner surface 52. Guide pin 40 has a profiled inner surface comprising a forward planar axial section 54, a rearward planar axial section 56, and an angled camming surface portion 60 intermediate of sections 54,56 which will be discussed below. Guide pins 38,40 serve to align plug connector 10 with receptacle connector 110 during blind mating thereof when the drawer is axially inserted into the rack. Each guide pin 38,40 preferably has a cavity such as cavity 41 of FIG. 4 extending axially thereinto from rear surface 28 to control shrinkage from the molding process.

Alignment surfaces 48,50 engage cooperating alignment bearing surfaces 148,150 of receptacle connector 110 at forward ends of alignment recesses 138,140 formed by hood sections 142,144, which are correspondingly semi-circular and are dimensioned to very closely match the outer surface of guide pins 38,40. Cooperating alignment bearing surfaces 148,150 comprise beveled lead-in surfaces on the inside thereof at forward ends of alignment recesses 138,140. Semi-circular hood section 144 associated with guide pin 40 is band-like having a selected limited axial length with its recess 140 being open at the rear end thereof, for a purpose discussed below.

Referring now to FIGS. 2 to 5, all the contact terminals are stamped and formed preferably of phosphor bronze alloy which is selectively gold plated at contact portions and selectively tin plated at connection portions at which they are terminated to respective electrical conductors. Such termination may be by crimping as shown, or by insulation displacement, soldering or welding. The terminals are disposed in respective terminal-receiving passageways 30,130 and are terminated to respective electrical conductors. In FIGS. 2 and 4, plug connector 10 has contact terminals 70,70A,70B terminated to conductors 72,72A,72B. Terminal 70 is a signal terminal terminated to a signal conductor 72. Terminal 70A is selected to be a ground terminal terminated to a ground conductor 72A, but otherwise may be identical to contact terminals 70. Terminal 70B is a power terminal terminated to a power conductor 72B and is similar to but about twice as wide as signal and ground terminals 70,70A.

Receptacle connector 110 has contact terminals 170,170A,170B terminated to conductors 172,172A,172B, as shown in FIGS. 3 and 5. Terminal 170 is a signal terminal terminated to a signal conductor 170. Terminal 170A is a ground terminal terminated to a ground conductor 172A, and is different from signal terminals 170 in that it is longer, extending farther forward of terminals 170 to electrically engage ground terminal 70A of plug connector 10 prior to terminals 170 engaging terminals 70 thereof. Terminal 170B is a power terminal terminated to a power conductor 172B and is bifurcated with two contact portions, and has a length equal to that of signal terminals 170.

More particularly in FIGS. 2, 3A and 4, signal terminals 70 are disposed along passageways 30 of plug housing 20. Conductors 72 are terminated to conductor-connecting sections 74 such as by crimping. Stop shoulder 76 of each terminal 70 abuts against a rear surface 64 of projection 62 extending into passageway 30 from a sidewall 58 thereof nearest camming surface 60 on guide pin 40 to prevent further forward axial movement of terminal 70 after insertion from rear surface 28 of plug housing 20. A locking lance 78 extends rearwardly from body section 80 of terminal 70 and rides over projection 62; when forwardly of the projection, locking lance 78 will move to its intended locking position so that its rearward end will abut a forward surface 66 of projection 62 and prevent rearward axial movement of terminal 70 after insertion thereof into passageway 30.

Forward portions 82 of terminals 70 extend forwardly from channel-shaped body sections 80 and are preferably planar and disposed against sidewalls 68 of passageways 30 which are on the side farthest from camming surface 60 on guide pin 40. Tapered forward ends 84 are disposed against the tapered lead-in surfaces of recessed front ends 98 of passageways 30 to assist in receiving extended portions 188 of contact terminals 170 of receptacle connector 110 during mating. Contact portions 86 comprise the forward parts of forward portions 82.

Signal terminals 70 preferably are pre-stressed by having forward portions 82 formed to a slight downward angle $\alpha$ from axial just forwardly of channel-shaped body portion 80, as seen in FIG. 3A. Such pre-stressing assures that forward ends 84 will be disposed against the tapered lead-in surface to receive the extended portion of a mating receptacle signal terminal 170. Because of such pre-stressing, body sections 80 of terminals 70 will be urged against sidewalls 58 of passageways 30 while forward portions 82 will be urged against sidewalls 68 at forward ends 84 when unmated.

Ground terminals 70A of plug connector 10 are identical to signal terminals 70 and are similarly pre-stressed. Power terminals 70B have wide forward portions 82B to receive both contact portions of a mating power terminal 170B of receptacle connector 110, and also are pre-stressed. Respective passageways 30B are correspondingly wide, and projections 62B are also wider.

FIGS. 3 and 5 show the placement of signal contact terminals 170 of receptacle housing 120. Contact terminals 170 are secured in passageways 130 in the same manner as contact terminals 70. Stop shoulder 176 engages rear surface 164 of projection 162, which extends into passageway 130 from sidewall 158 nearest cooperating camming surface 160. The rearward end of locking lance 178 engages forward surface 166 of projection 162 when terminals 170 are inserted fully into passageways 130 from rear surface 128 of receptacle housing 120. Conductors 172 are terminated to conductor-connecting sections 174 of the contact terminals and extend rearwardly from rear surface 128.

Contact terminals 170 have channel-shaped body sections 180 forwardly from which extend forward portions 182 which are disposed along passageway sidewalls 168 which are on the side farthest from cooperating camming surface 160. Each extended portion 188 thereof extends forwardly of mating face 126. Contact portion 186 on extended portion 188 comprises preferably a rounded depression therein, termed a Hertzian dot, extending away from the direction of camming. Forwardly of contact portion 186 is an angled tip 184.

Signal, ground and power terminals 170,170A,170B are pre-stressed similarly to signal terminal 70 as shown in FIG. 3A. Ground contact terminal 170A has an extended portion 188A extending forwardly of mating face 126 a distance farther than extended portions 188. Contact portion 186 is disposed along extended portion 188A and aligned with contact portions 186 also preferably comprising a rounded depression extending away from the direction of camming. Forwardly of contact portion 186A is vanguard portion 190A having an angled tip 184A at the end thereof, and also having a rounded depression 192A extending away from the direction of camming. Each power terminal 170B has two coextending forward portions 182B and extended portions comprising tines 188B each of which has a rounded depression 186B thereon comprising the contact portions. Respective passageways 130B are correspondingly wide to retain power terminals 170B, and projections 162B are also wide.

Referring now to FIGS. 6 and 7, when plug connector 10 mounted on drawer end panel 12 is being mated to receptacle connector 110 mounted on rack panel 112, guide pins 38,40 enter alignment recesses 138,140. Alignment bearing surfaces 48,50 engage cooperating alignment bearing surfaces 148,150 at certain points around the semi-circular hood sections 142, 144 due to anticipated slight misalignment of plug connector 10 with receptacle connector 110. The half-conical shape of alignment surfaces 148,150 allows for such initial points of engagement to occur at any point around the semi-circular hood sections 142,144 and still function well to align the connectors both laterally and angularly. Guide pins 38,40 will be urged by the bearing engagement of the tapered nature of the surfaces into concentric alignment with the axes of semi-circular hood sections 142,144 and thus precisely align plug connector 10 in receptacle connector 110 with plug connector 10 mounted to panel 12 in such a way as to be allowed to "float" along the surface of panel 12.

After such alignment, angled camming surface portion 60 of guide pin 40 will be brought to a position adjacent cooperating camming surface portion 160 on the outside of wall portion 146 of receptacle connector 110 rearwardly of semi-circular hood section 144. Upon continued forward movement of plug connector 10, camming surface portion 60 will engage and bear against camming surface portion 160 which engagement will provide a force to plug connector 10 in an axially normal direction which is normal to receptacle wall portion 146 and is termed herein the direction of camming. As a result, plug connector 10 will be urged a selected small distance D along the direction of camming, and rearward planar section 56 of guide pin 40 will be adjacent receptacle wall portion 146. Along side surface 44 of plug connector 10 rearwardly from guide pin 40 is a recessed portion 46 which receives semi-circular hood section 144 thereagainst when plug connector 10 is urged distance D along the direction of camming, as is shown in FIG. 7.

It is preferable that camming surface portion 60 have an angle $\beta$ equal to about 30° from axial, but the angle may range from about 10° to about 45° and still be practical. The smaller the angle $\beta$ is, the longer in axial length the camming surfaces must be for a given camming distance D, and the longer the receptacle contact terminals 170,170A,170B must be. The larger the angle $\beta$ is, the more abrupt is the axially normal movement and the larger the stress on the camming surfaces resulting from axial momentum of the drawer.

Figure 8:
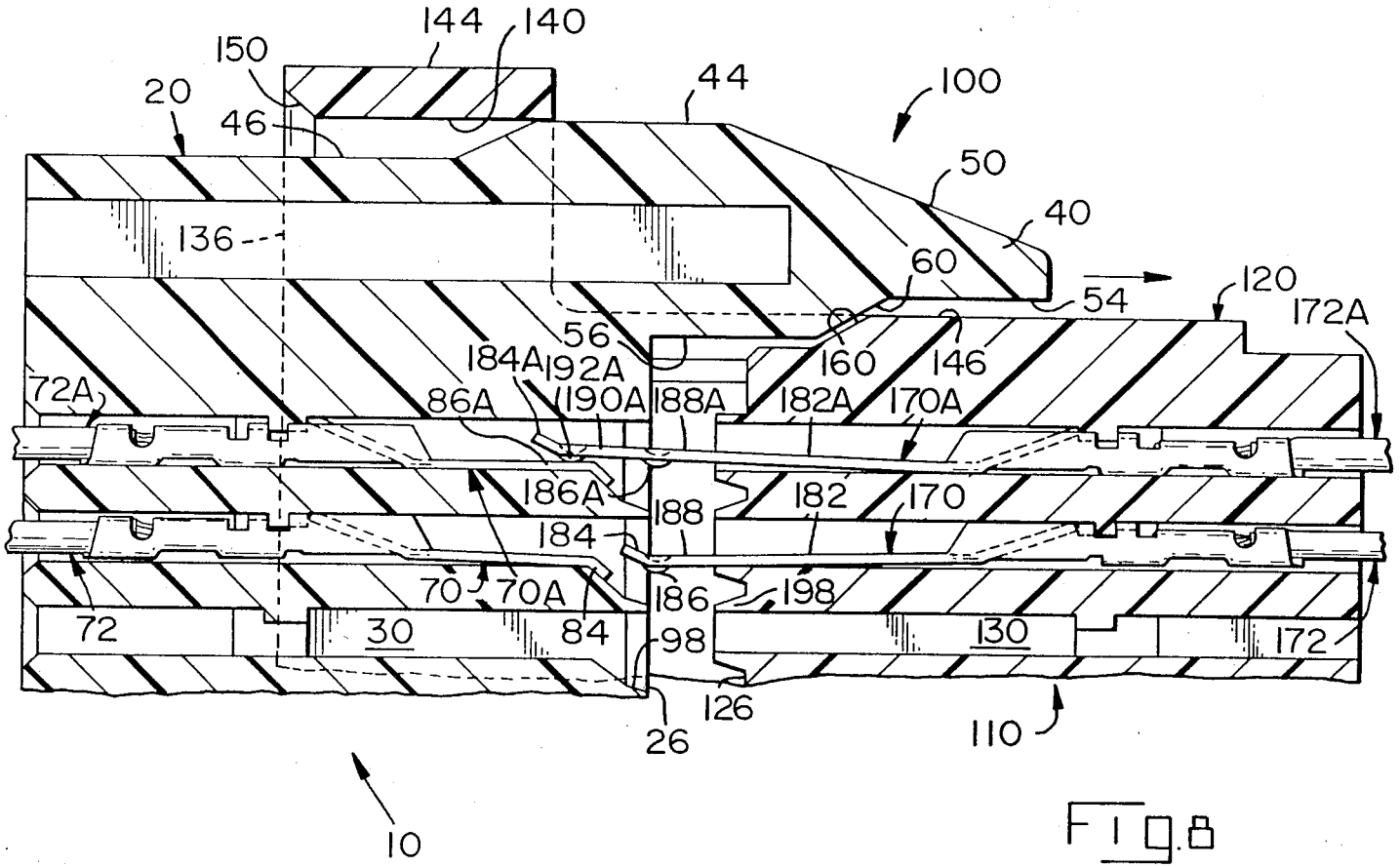
FIGS. 8 and 9 shows the plug and receptacle connectors of FIGS. 6 and 7 before camming, and after axial camming to their mated condition respectively.
Figure 9:
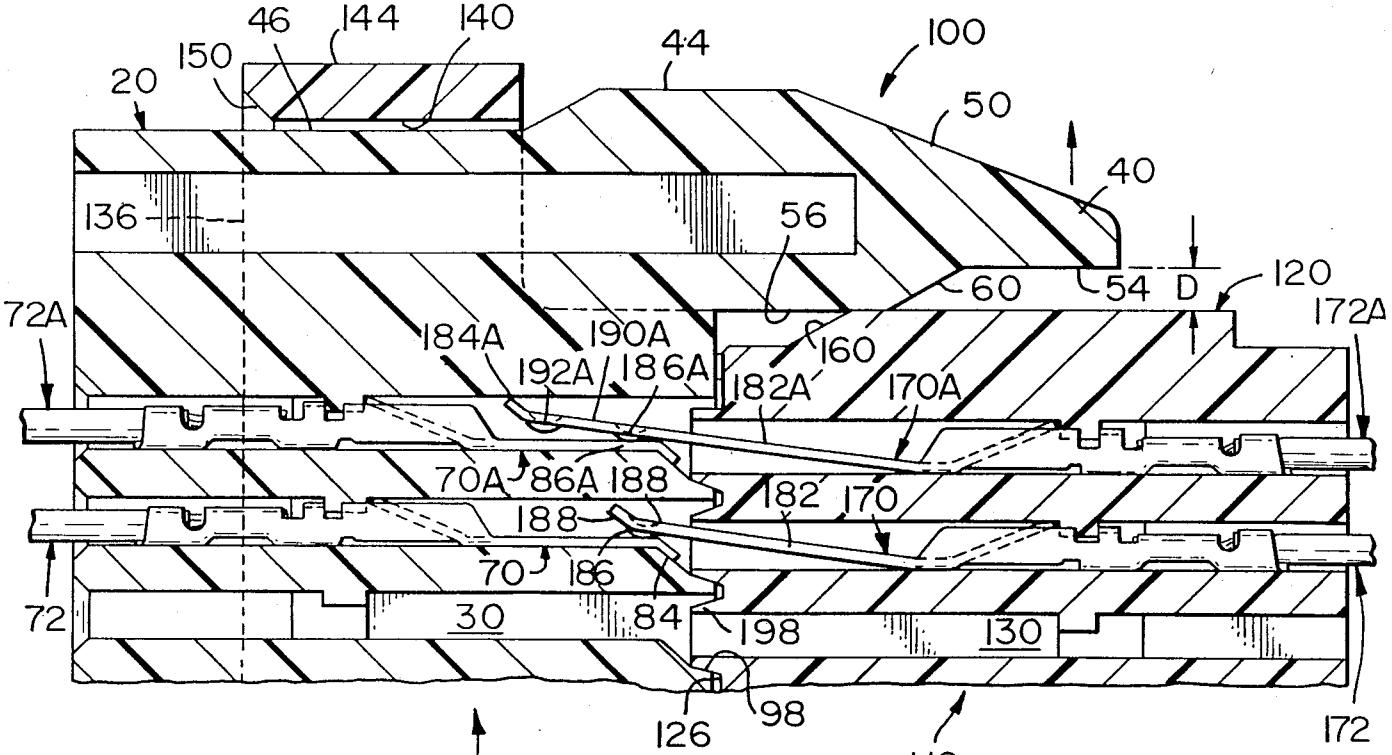

During mating, as shown in FIGS. 8 and 9 vanguard portion 190A of ground contact 170A of receptacle connector 110 will electrically engage ground contact 70A of plug connector 10 prior to any other electrical engagements of terminals. Angled tip 184A will enter forward end 98A of passageway 30A and engage tapered end 84A of ground contact 70A and be urged laterally in the direction of camming with forward portion 182A thereof acting in cantilever spring arm fashion. Depression 192A will engage contact portion 86A and form an assured first electrical engagement therewith, thus grounding receptacle connector 110 with plug connector 10. (Similarly, during unmating ground terminals 70A,170A will break engagement last.) Extended portions 188,188B of contact terminals 170,170B will then enter forward ends 98,98B of passageways 30,30B. As camming surface 60 of guide pin 40 becomes adjacent cooperating camming surface 160, tapered terminal ends 184,184B will come into engagement with tapered ends 84,84B of contact terminals 70,70B and be urged slightly laterally in the direction of camming, and all contact portions 186,186A,186B will then come into engagement with contact portions 86,86A,86B.

As shown in FIG. 9, cooperating camming surface 160 of receptacle connector 110 will urge camming surface 60 and plug connector 10 a distance D in the direction of camming. Contact terminals 170,170A,170B will be urged and biased in cantilever spring arm fashion by the camming of plug connector 10, creating a substantial contact force normally between contact portions 186,186A,186B of contact terminals 170,170A,170B of the receptacle connector, and contact portions 86,86A,86B on forward portions 82,82A,82B of contact terminals 70,70A,70B of the plug connector, respectively.

The contact insertion force of the terminals in the connectors of the present invention is believed to be about up to ½ lb. per mating pair. Thus, for a twenty-five position connector assembly, the total contact insertion force would be up to 12½ lbs. as compared to up to 50 lbs. of the prior art connector assembly.

Electrical engagement between the contact terminals of the plug and receptacle connectors is assured by the substantial contact force thus provided by the biasing of contact terminals 170,170A,170B without substantial wear and tear on the terminals, which would have been caused by repeated mating and unmating cycles of terminals having high insertion force. Necessary wiping action between contact portions of mating contact terminals is maintained in the connector assembly of the present invention, which wipes away oxides forming on the contact surfaces.

As best seen in FIG. 9, forward ends 198 of passageways 130 of receptacle connector 110 are raised and extend forwardly from mating surface 126, and corresponding forward ends 98 of plug connector passageways 30 are recessed to receive forward ends 198 to increase the electrical tracking distance to minimize the risk of arcing between terminals.

It is possible to utilize more than one ground terminal pair 70A,170A with connector assembly 100, with more such ground pairs used with connectors having greater numbers of signal contacts. Similarly, it is possible to utilize more than one power terminal pair 70B,170B, such as using three such pairs in a twenty-five position connector assembly, as shown. It is possible to have a larger number of contacts than twenty-five pairs, such as fifty pairs or more in a connector assembly of the present invention, and maintain a reasonable level of total contact insertion force. With such a larger number of contact terminals, it is possible and foreseeably practical to utilize several contact terminals identical to signal terminals 70,170 to conduct power, in lieu of each mating pair of the wider power terminals 70B,170B and thus have passageways 30,130 all the same size for convenience.

Figure 10:
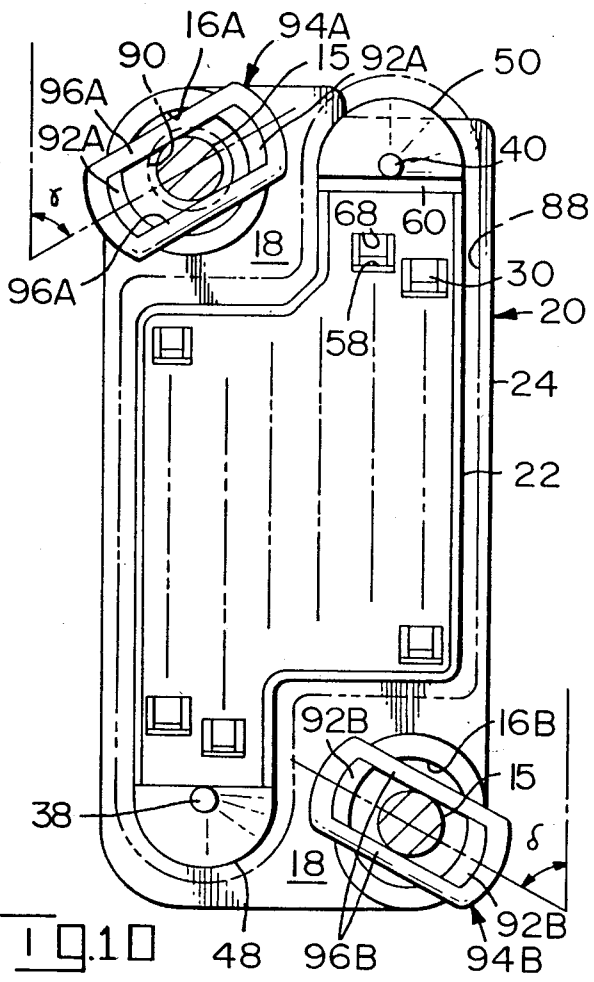
FIG. 10 is a front view of the plug connector showing the elastomeric centering members secured thereon for improved mounting.

With reference to FIGS. 10 and 1, plug housing 20 has a base portion 24 having flanges 18 through which extend oblong mounting holes 16. Mounting face 34 of base portion 24 is proximate but spaced slightly from the inner surface 36 of drawer end panel 12 about the periphery of an aperture 88 therethrough, through which extend conductors 72,72A,72B. Aperture 88 should have the same shape as the cross-section of plug housing body portion 22 except to be larger around the periphery to allow for aligning movement and for receipt of the front end of receptacle hood 136, and also longer by a distance D in the camming direction to allow for camming movement of plug connector 10. Shoulder screws 14 extend through mounting holes 16 in flanges 18 and through corresponding preferably threaded holes 90 in panel 12 and are bolted. Mounting holes 16 each have a dimension larger than the diameter of unthreaded shank portion 15 of a shoulder screw 14, and each is also oblong in the camming direction by a distance D.

In FIG. 10, around the top of mounting hole 16A are opposing arcuate projections 92A located at a substantial angle $\gamma$ from the major axis of the plug connector such as between 30° and 75°, and preferably about 60°. Projections 92B around mounting hole 16B are located at an angle $\delta$ from the major axis of the plug connector preferably equal to angle $\gamma$ and symmetrically on the opposite side of the major axis of the plug. Elastomeric ring-like members 94A,94B are made of elastomeric material such as an O-ring of polyurethane and are each elastically secured around a respective pair of projections 92A and 92B, thus becoming elongated having a respective major axis disposed at angles $\gamma$, $\delta$ respectively from the direction of the plug's major axis. Members 94A,94B each have a respective minor axis extending between free sides 96A,96B centrally thereof.

Front surfaces of unthreaded shank portions 15 of shoulder screws 14 tightly engage inner panel surface 36 when mounted such as by using nuts. The heads of shoulder screws 14 are selected to have a size appropriately wider than oblong mounting holes 16A,16B. Float mounting occurs because plug connector 10 is dimensioned to be spaced a slight distance from inner panel surface 36 at projections 92A,92B and elastomeric members 94A,94B, by reason of rear surface 28 engaging the screw heads and screw shank portions 15 engaging inner panel surface 36.

Free sides 96A,96B of respective elastomeric members 94A,94B will engage unthreaded shank portions 15 of respective shoulder screws 14. After mounting and prior to mating, plug connector 10 is held in a substantially centered and aligned orientation by the cooperating urging of free sides 96A,96B of the two elongated elastomeric members tending to center the shank portions 15 of shoulder screws 14 along the minor axes of members 94A,94B. It is more accurate to say that members 84A,94B center the plug connector 10 about the shoulder screws 14.

It is believed preferred to have projections 92A,92B and elastomeric members 94A,94B cooperate to hold plug connector in a centered position which is offset intentionally half of distance D or more out of alignment in the unmated state; during the alignment phase of mating plug connector 10 will move to an aligned position the offset distance in the direction opposed to the direction of camming; during camming the plug connector will move distance D in the direction of camming and remain there while mated. This is preferred to reduce the long-term stress on elastomeric members 94A,94B while connector assembly 100 is mated because of being urged in a stressed state against shank portions 15. It may be practical to offset plug connector a full distance D from the aligned position prior to mating, requiring significant alignment movement, to minimize the stress on the elastomeric members 94A,94B after mating and minimize the possibility of their becoming deformed due to long-term stress.

The float mounting means of the present invention can also be advantageously utilized on a standard drawer connector not utilizing the camming means of the present invention, in which case it is not necessary that mounting holes 16 be oblong.

An alternative method of mounting could place the plug connector on the outside surface of the drawer end panel, with the direction of the shoulder screws reversed, and using friction-reducing washers underneath the heads of the shoulder screws to bearingly engage forward surfaces of projections 92A,92B.

It is also possible to mount the receptacle connector on the drawer end panel, and float mount the plug connector on the rack panel. Other variations may occur which are within the spirit of the invention and the scope of the claims.

What is claimed is:

1. A float mounting means for a drawer connector assembly having a receptacle connector mounted by second securing means to a second panel and a plug connector mounted by first securing means to a first panel alignable with said receptacle connector during mating thereof, comprising:

mounting holes extending axially through flanges of at least one of said plug and said receptacle connector through which extend unthreaded shank portions of shoulder screws, said mounting holes each having a diameter larger than the diameter of a respective said screw shank portion and each said shoulder screw having a head portion larger than a respective said mounting hole;

a pair of opposed projections extending forwardly from around each said mounting hole; and an elastomeric member associated with each said mounting hole and disposed elastically around said opposed projections across said mounting hole, and having an elongate shape with a major axis and a minor axis, each said elastomeric member having free sides elastically engaging said unthreaded shank portion of a respective said shoulder screw extending through said mounting hole and secured to a respective one of said first and said second panels, whereby said plug and said receptacle connectors are capable of relative axially normal movement during alignment during mating thereof.

2. A float mounting means as set forth in claim 1 wherein one said elongated elastomeric member associated with said at least one of said connectors has its minor axis disposed at a selected substantial angle from the major axis of said at least one of said connectors, and the other said elongated elastomeric member has its minor axis disposed at the opposite angle from said selected angle such that said minor axes are symmetrically oriented with respect to said connector major axis, said selected substantial angle being less than 90°, whereby centering of said at least one of said connectors by reason of said centering of said respective shank portions of said shoulder screws within said mounting holes occurs along two directions at equal angles substantial from and symmetrically about said connector major axis.

3. A float mounting means as set forth in claim 2 wherein said selected substantial angle is between about 30° and 75°.

4. A float mounting means as set forth in claim 3 wherein said selected angle is about 60°.

* * * * *